US009456717B2

(12) United States Patent
Kullman et al.

(10) Patent No.: US 9,456,717 B2
(45) Date of Patent: Oct. 4, 2016

(54) DISPENSER

(75) Inventors: Marcus Kullman, Vikmanshyttan (SE); Mats Lind, Vikmanshyttan (SE); Christian Söderlund, Vikmanshyttan (SE); Michael Gustafsson, Vikmanshyttan (SE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 344 days.

(21) Appl. No.: 13/381,119

(22) PCT Filed: Jun. 30, 2009

(86) PCT No.: PCT/SE2009/050838

§ 371 (c)(1),
(2), (4) Date: Jan. 31, 2012

(87) PCT Pub. No.: WO2011/002361

PCT Pub. Date: Jan. 6, 2011

(65) Prior Publication Data

US 2012/0125795 A1 May 24, 2012

(51) Int. Cl.

| | |
|---|---|
| ***B65H 18/02*** | (2006.01) |
| ***A47K 10/38*** | (2006.01) |
| *A47K 10/32* | (2006.01) |

(52) U.S. Cl.

CPC ... *A47K 10/3818* (2013.01); *A47K 2010/3233* (2013.01); *A47K 2010/3246* (2013.01)

(58) Field of Classification Search

USPC ..... 242/593, 596.8, 597.8, 598.5, 132, 137, 242/146; 206/409, 390, 394, 205, 210, 812; 220/253; 221/1, 62, 63

See application file for complete search history.

(56) References Cited

U.S. PATENT DOCUMENTS

| | | | | |
|---|---|---|---|---|
| 3,628,743 | A * | 12/1971 | Bastian et al. | 242/560.1 |
| 5,697,576 | A * | 12/1997 | Bloch et al. | 242/596.8 |
| 5,715,971 | A * | 2/1998 | Morand | 221/45 |
| 5,765,718 | A * | 6/1998 | Grasso et al. | 221/62 |
| 5,803,373 | A * | 9/1998 | Sedlock et al. | 242/596.8 |
| 6,024,323 | A * | 2/2000 | Palermo, Jr. | 242/588.6 |
| 6,386,479 | B1 * | 5/2002 | Lewis et al. | 242/596.8 |

(Continued)

OTHER PUBLICATIONS

International Search Report (PCT/ISA/210) issued on Mar. 16, 2010, by Swedish Patent Office as the International Searching Authority for International Application No. PCT/SE2009/050838.

(Continued)

*Primary Examiner* — Emmanuel M Marcelo
*Assistant Examiner* — Justin Stefanon
(74) *Attorney, Agent, or Firm* — Buchanan Ingersoll & Rooney PC

(57) ABSTRACT

A dispenser including a housing and a door pivotally attached to the housing via a substantially vertically arranged hinge. The housing includes a hinge wall, an upper end wall, a substantially vertical wall and a lower end wall. The walls define an edge delimiting a lateral charge opening. The housing is provided with a dispensing opening at the lower end wall. The door includes an essentially vertical portion, a free end opposite the hinge and a door rim at lest partly adjacent the edge of the housing when the door is in a closed position. The edge of the housing has a free edge portion extending along the upper end wall, the substantially vertical wall and the lower end wall. The free edge portion includes a guiding element for co-operation with a region of the door rim during pivoting of the door towards the closed position and for vertically positioning the free end of the door.

18 Claims, 5 Drawing Sheets

(56) References Cited

U.S. PATENT DOCUMENTS

| | | | | |
|---|---|---|---|---|
| 6,869,041 | B1 * | 3/2005 | Allegre et al. | 242/593 |
| 6,959,891 | B2 * | 11/2005 | Kapiloff et al. | 242/597.8 |
| 7,131,609 | B1 * | 11/2006 | Lewis et al. | 242/593 |
| 7,275,672 | B2 * | 10/2007 | Haen et al. | 225/106 |
| 2003/0122031 | A1 * | 7/2003 | Tramontina et al. | 242/593 |
| 2006/0261076 | A1 * | 11/2006 | Anderson | 221/33 |
| 2007/0079676 | A1 | 4/2007 | Friesen et al. | |
| 2008/0290210 | A1 | 11/2008 | Tramontina et al. | |
| 2009/0120950 | A1 * | 5/2009 | Titas et al. | 221/45 |
| 2012/0104014 | A1 * | 5/2012 | Hamer et al. | 221/1 |

OTHER PUBLICATIONS

Written Opinion (PCT/ISA/237) issued on Mar. 16, 2010, by Swedish Patent Office as the International Searching Authority for International Application No. PCT/SE2009/050838.

European Communication dated Nov. 28, 2014 issued in the corresponding European Patent Application No. 09846907.5-1601 (8 pages).

* cited by examiner

DISPENSER

TECHNICAL FIELD

The disclosure relates to a dispenser for paper or the like adapted to be mounted on a wall or similar structure.

BACKGROUND OF THE INVENTION

Dispensers for paper or the like to be mounted on walls or similar structures of many kinds are known. Simple models may comprise a wall mounting bracket and an axle around which a roll of paper or the like is suspended. More elaborate models may comprise a housing provided with a charge opening for replenishing the dispenser with the paper or the like and a door for covering the charge opening.

SUMMARY OF THE INVENTION

An object of the present invention is to ensure that a dispenser for paper or the like with a door suspended from a substantially vertical hinge mates smoothly and securely to correctly fit its intended seat on a housing of the dispenser when the door is closed.

According to an aspect of the invention, the object is achieved by a dispenser for paper or the like adapted to be mounted on a wall. The dispenser comprises a housing for receiving the paper or the like and a door pivotally attached to the housing via a substantially vertically arranged hinge. The housing comprises a hinge wall associated with the substantially vertically arranged hinge, an upper end wall, a substantially vertical wall and a lower end wall. The walls define an edge delimiting a lateral charge opening in the housing for replenishing the dispenser with the paper or the like. The housing is provided with a dispensing opening for the paper or the like at the lower end wall. The door comprises an essentially vertical portion, a free end opposite the hinge and a door rim at least partly adjacent the edge of the housing when the door is in a closed position. The door is adapted to cover the charge opening. The edge of the housing has a hinge portion at the hinge wall and a free edge portion extending along the upper end wall, the substantially vertical wall and the lower end wall. The free edge portion or the housing in proximity of the free edge portion comprises a guiding element for co-operation with a region of the door rim during pivoting of the door towards the closed position for vertically positioning the free end of the door. The guiding element is provided with an upwardly inclined surface seen in a direction from the door towards the housing in a horizontal plane.

Since the guiding element co-operates with a region of the door rim, the region of the door rim may slide along the upwardly inclined surface of the guiding element as the door of the dispenser is being closed. Accordingly, when the door is fully closed it will line up with the housing of the dispenser. The invention may be put to use in dispensers with slender doors, which in an open position may even appear to be flimsy. Such a door may sag at its free end when it is open. Here in particular, the region of the door rim may slide along the inclined surface of the guiding element to lift the free end of the door and position it vertically. Also in a situation where a person closing the door subjects the free end of the door to a downwardly directed force the region of the door rim may slide along the upwardly inclined surface of the guiding element to ensure that the end of the door is correctly positioned when the door reaches the closed position.

As a result, the above mentioned object is achieved.

The dispenser for paper or the like may commonly, but not exclusively, be mounted in a restroom or close to a handbasin or sink in a public establishment, industrial or kitchen premises. The term "paper or the like" refers to paper, tissue, non-woven material or similar sheet material for wiping surfaces or objects. The paper or the like may form a stack of separate sheets inside the dispenser or be provided in sequence or continuously on a roll. The paper and the like is grasped by a user through the dispensing opening. It is understood that the term "wall" is to be interpreted as meaning any structure or device having an essentially vertical surface suitable for mounting a dispenser thereon, including a side wall of a cupboard and a door face. It is further to be understood that the term "region of the door rim" may encompass a region of the actual rim itself as well as a portion of the door adjacent the actual rim. Likewise the edge of the housing delimiting the lateral charge opening is understood to comprise an end portion of the respective walls of the housing, close to the edge.

According to example embodiments the guiding element may be formed by a section of the free edge portion. In this manner a part of the walls may incorporate the guiding element and provide vertical positioning of the free end of the door.

According to example embodiments the guiding element may comprise an essentially horizontally extending protrusion. Shaped as a protrusion, the guiding element may provide an early support of the region of the door rim in comparison with a guiding element at a level of the free edge portion.

According to example embodiments the essentially horizontally extending protrusion may protrude from the section of the free edge portion. In this manner the region of the door rim may form part of the actual rim of the door and may slide on the guiding element with the extending protrusion to vertically position the free end of the door.

According to example embodiments the essentially horizontally extending protrusion may be separate from the free edge portion. In this manner the guiding element comprising the extending protrusion may be arranged below the upper end wall or the lower end wall such that the region of the door forming part of the actual rim of the door may slide along the guiding element. Alternatively, the region of the door rim may comprise a heel arranged on a portion of the door adjacent the actual rim. The heel may slide on the guiding element to vertically position the free end of the door. Such a guiding element comprising the protrusion, separate from the free edge portion, may be provided for example below the upper end wall of the housing, on an inside of the substantially vertical wall of the housing or above the lower end wall of the housing. Consequently, the heel on the door may be provided below the door rim at an upper end of the door, on an inside of the door along the door rim at a side of the door opposite the substantially vertically arranged hinge or above the door rim at a lower end of the door, respectively.

According to example embodiments the region of the door rim may be a corner portion adapted to move over the guiding element. In this manner a naturally protruding part of the door may be utilized for vertically positioning the free end of the door. The corner portion may be formed by a discontinuity in the door rim and the free edge portion at a corresponding wall of the housing may be provided with a segment fitting the discontinuity. The discontinuity and the segment may be essentially arc-shaped in an essentially horizontal plane.

According to example embodiments at least a part of the door rim may form an overlap with the free edge portion when the door is in the closed position, and the door and the housing may at least partly abut in the overlap. In this manner a safe transition between the door and the housing may be provided, ensuring e.g. a splash proof dispenser. The overlap may extend essentially uninterruptedly in a horizontal plane from one end of the upper end wall to an opposite end of the upper end wall in a first direction transverse to a second direction extending in the horizontal plane from the housing towards the door. Thus, an upper end of the dispenser may be made splash proof.

According to example embodiments adjacent to the overlap on an external surface of the dispenser at least part of: the upper end wall, the substantially vertical wall and/or the lower end wall, or in the alternative at least part of the door adjacent to said rim, abuts a ridge in an essentially vertical plane. An abutment between the door and the housing along the overlap as well as along the ridge may provide an end stop and may further improve splash properties of the dispenser. The ridge may extend essentially in the first direction. Along the upper end wall this may improve splash properties of the upper end of the dispenser.

According to example embodiments the housing may have an essentially cylindrical shape and the essentially vertical portion of the door may be curved and form part of the cylindrical shape. Thus, the dispenser may hold rolls of the paper or the like.

According to example embodiments the dispenser may be adapted to hold a roll of paper or the like, from a centre of which roll the paper or the like is adapted to be grasped through the dispensing opening of the dispenser.

Further features of, and advantages with, the present invention will become apparent when studying the appended claims and the following description. Those skilled in the art will realize that different features of the present invention may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

The present invention will now be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout.

As used herein, the term "comprising" or "comprises" is open-ended, and includes one or more stated features, elements, steps, components or functions but does not preclude the presence or addition of one or more other features, elements, steps, components, functions or groups thereof.

As used herein, the term "and/or" includes any and all combinations of one or more of the associated listed items.

As used herein, the common abbreviation "e.g.", which derives from the Latin phrase "exempli gratia," may be used to introduce or specify a general example or examples of a previously mentioned item, and is not intended to be limiting of such item. If used herein, the common abbreviation "i.e.", which derives from the Latin phrase "id est," may be used to specify a particular item from a more general recitation.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present.

Well-known functions or constructions may not be described in detail for brevity and/or clarity.

Figure 1:
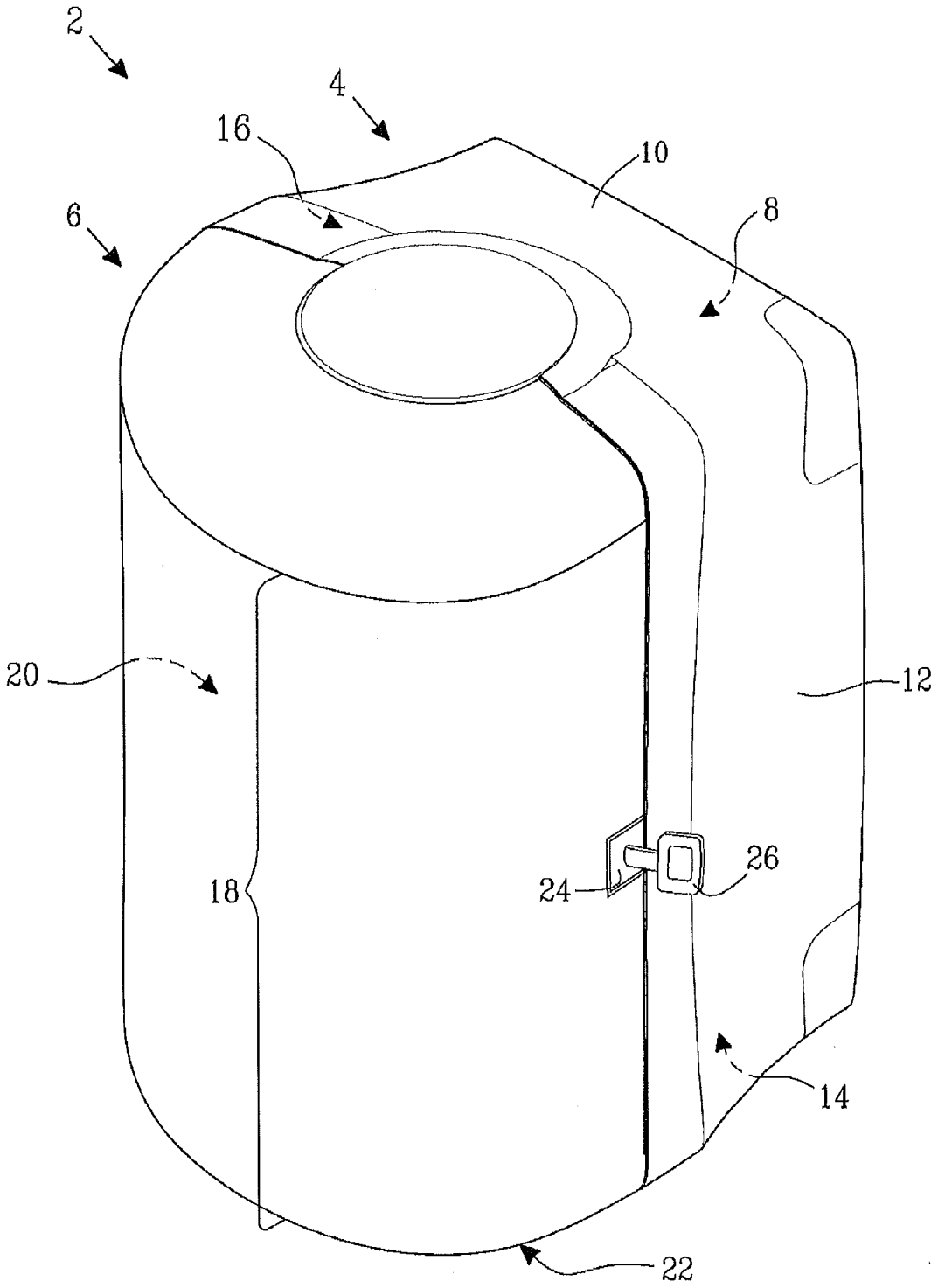
FIG. 1 illustrates a dispenser according to example embodiments.

FIG. 1 illustrates a dispenser 2 according to example embodiments. The dispenser 2 is essentially cylindrically shaped and is adapted to contain a roll of paper or similar sheet material, from the centre of which the sheet material is withdrawn. The dispenser 2 comprises a housing 4 and a door 6 pivotally attached to the housing 4 by means of a substantially vertically arranged hinge (not visible in FIG. 1). The housing 4 is adapted to be mounted with a rear side 8 against a wall or similar structure. The housing 4 comprises an upper end wall 10, a substantially vertical wall 12, a lower end wall 14 and a hinge wall 16. The door 6 comprises an essentially vertical portion 18, a hinge end 20 and a free end 22 opposite to the hinge end 20. The essentially vertical portion 18 is curved and thus forms part of the cylindrical shape of the dispenser 2. The hinge end 20 of the door 6 is a portion of the door 6 in proximity of the hinge. The free end 22 of the door 6 extends from the hinge end 20 over a larger part of the door 6. The dispenser 2 comprises a lock 24 for locking the door 6 to the housing 4. If a removable key 26 is provided an interior of the dispenser 2 may only be accessed by a holder of the key 26.

Figure 2:
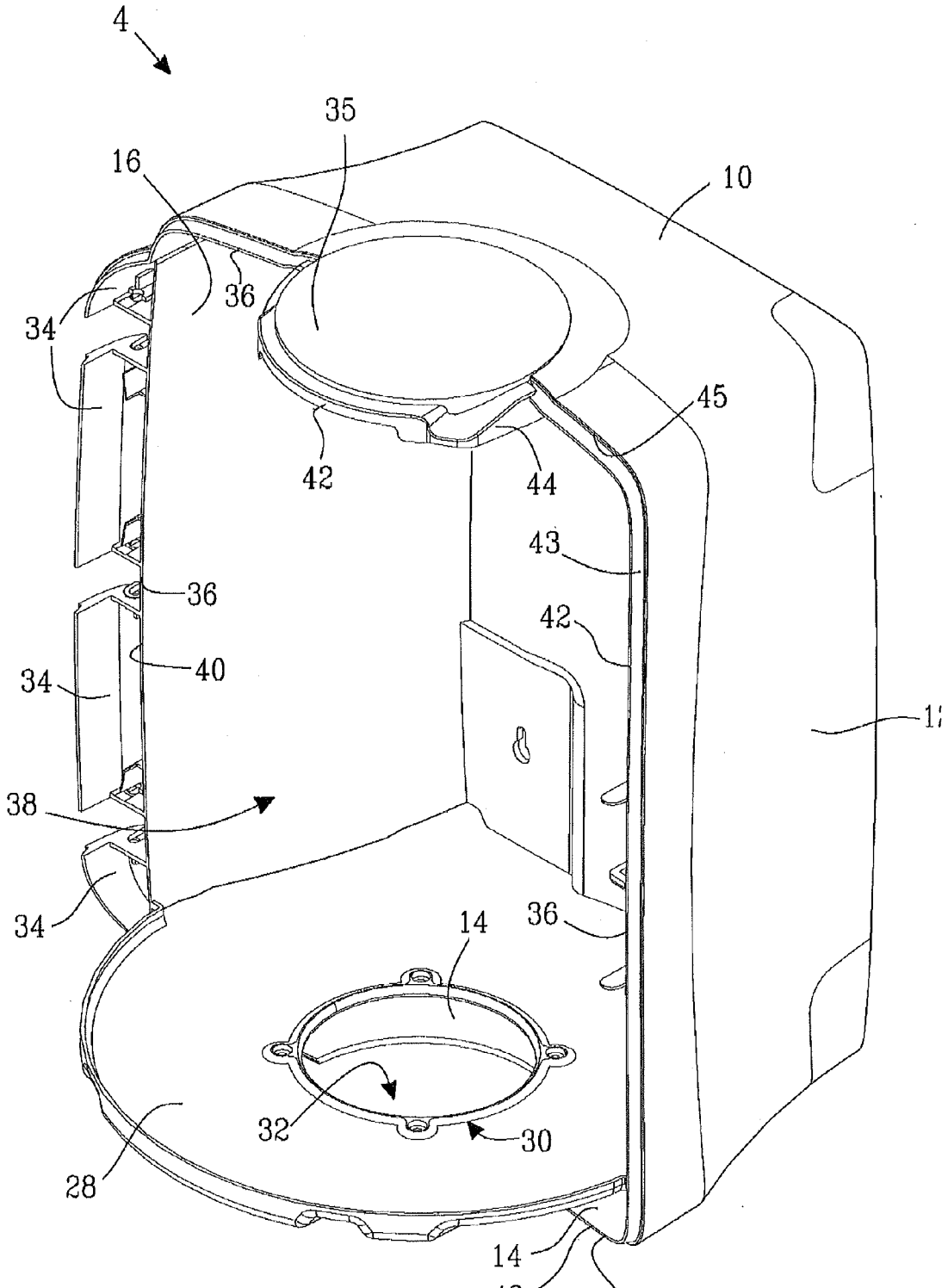
FIG. 2 illustrates a housing of the dispenser according to example embodiments shown in FIG. 1.

FIG. 2 illustrates a housing 4 of the dispenser 2 according to example embodiments shown in FIG. 1. The housing 4 comprises a shelf 28 for supporting a vertically standing roll of sheet material inside the dispenser. The shelf 28 is provided with an aperture 30, through which the sheet material may be fed from the centre of the roll downwards towards and further through a dispensing opening 32 at the lower end wall 14 of the housing 4. At the hinge wall 16 of the housing 4 there is attached a first hinge member 34 of a substantially vertical hinge. The upper end wall 10 is provided with an arc-shaped segment 35 protruding in the direction of the door 6. The upper end wall 10, the substantially vertical wall 12, the lower end wall 14 and the hinge wall 16 define an edge 36, which delimits a lateral charge opening 38 through which the dispenser 2 may be replenished with rolls of sheet material and to be closed by the non-shown door 6. The edge 36 has a hinge portion 40 at the hinge wall 16 and a free edge portion 42 extending along the upper end wall 10, the substantially vertical wall 12 and the lower end wall 14.

The free edge portion 42 comprises an overlap portion 43 adapted to form an overlap with a door rim of the door 6 when it is in a closed position. The free edge portion 42 and the door rim may at least partly abut in the overlap. Adjacent the overlap portion 43, the free edge portion 42 is provided with a ridge 45. When the door 6 is in a closed position at least part of the door rim will be arranged on an outer side of the housing 4 in the overlap portion 43. Thus, due to the ridge 45, the outer surfaces of the housing 4 and the door 6 will be flush.

A section of the free edge portion 42 at the upper end wall 10 forms a guiding element 44, embodiments of which will be described in more detail below. The guiding element 44 has an upwardly inclined surface seen in a direction from the charge opening 38 towards the upper end wall 10. The guiding element 44 is adapted to co-operate with a region of the door rim of the door 6 when the door 6 is moved from an open position to a closed position such that the free end 22 of the door 6 is positioned vertically.

Figure 3:
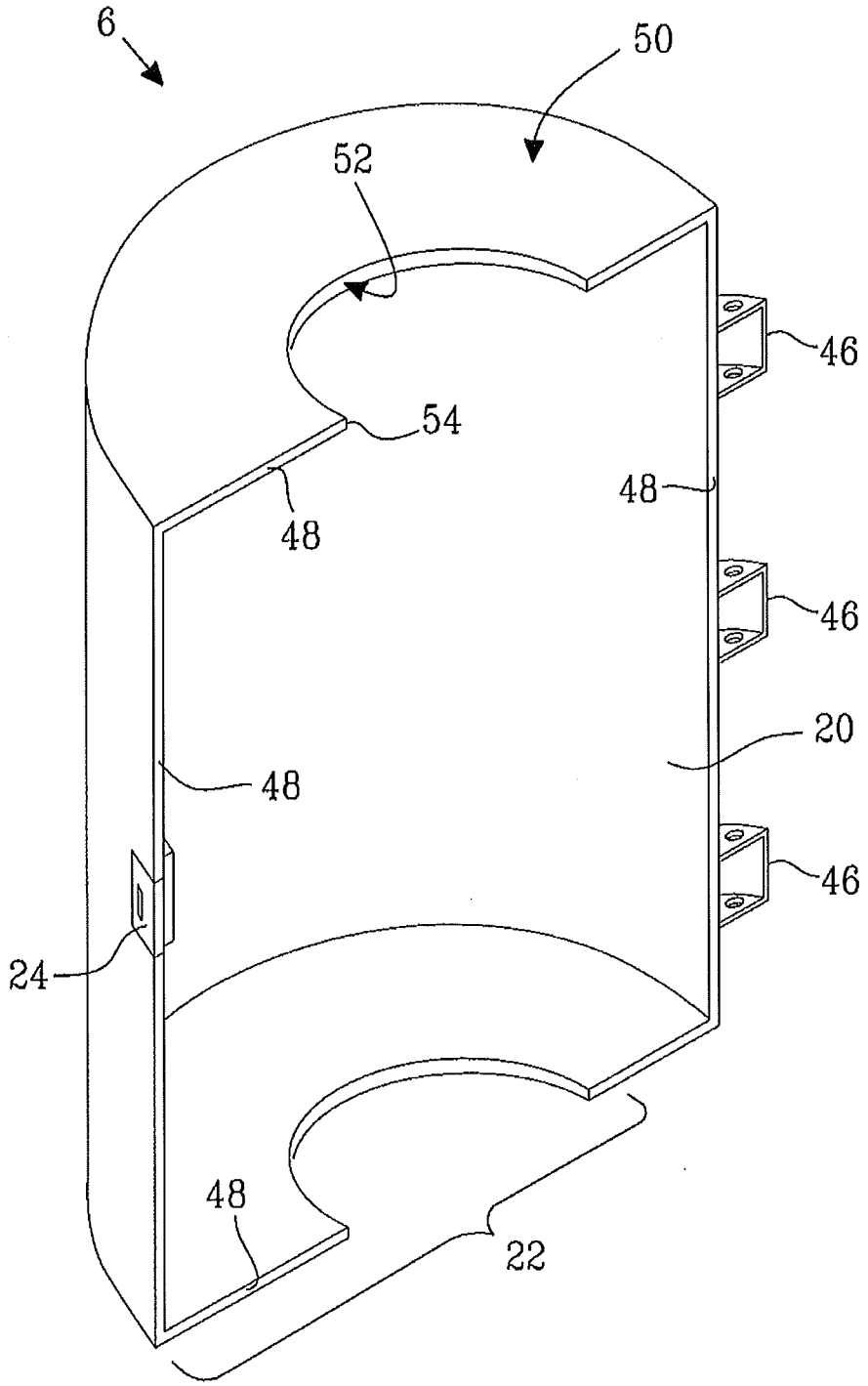
FIG. 3 illustrates schematically a door of the dispenser according to example embodiments shown in FIG. 1, FIGS. 4 and 5 illustrate guiding elements of dispensers according to example embodiments.

FIG. 3 illustrates schematically the door 6 of the dispenser 2 according to example embodiments shown in FIG. 1. At the hinge end 20 the door 6 is provided with a second hinge member 46. The first and second hinge members 34, 46 are engaged with each other by means of a hinge pin extending through holes in the first and second hinge members 34, 46 and thus form a substantially vertically arranged hinge. The door 6 pivots by means of the hinge between an open position, in which the charge opening 38 is accessible and a closed position, in which the charge opening 38 is covered by the door 6. The door 6 comprises a door rim 48 along edges of the hinge end 20 and the free end 22. At its upper end the door 6 is provided with a substantially horizontal portion 50. The horizontal portion 50 is provided with a discontinuity 52, which is arc-shaped and adapted to mate with the segment 35 of the upper end wall 10 of the housing 4. Due to the discontinuity 52 the door rim 48 comprises a distinct region in the form of a corner 54. When the door 6, attached to the housing 4, is moved from an open position towards a closed position the region of the door rim 48 in the form of the corner 54 will pass over the guiding element 44. If the door 6 is orientated slightly downwards at its free end 22 the corner 54 will touch the inclined surface of the guiding element 44 and be urged upwards during closing of the door 6 such that the free end 22 of the door 6 is positioned vertically. Accordingly, the door rim 48 will line up with the edge 36 of the housing 4 when the door 6 arrives at the closed position.

Figure 4:
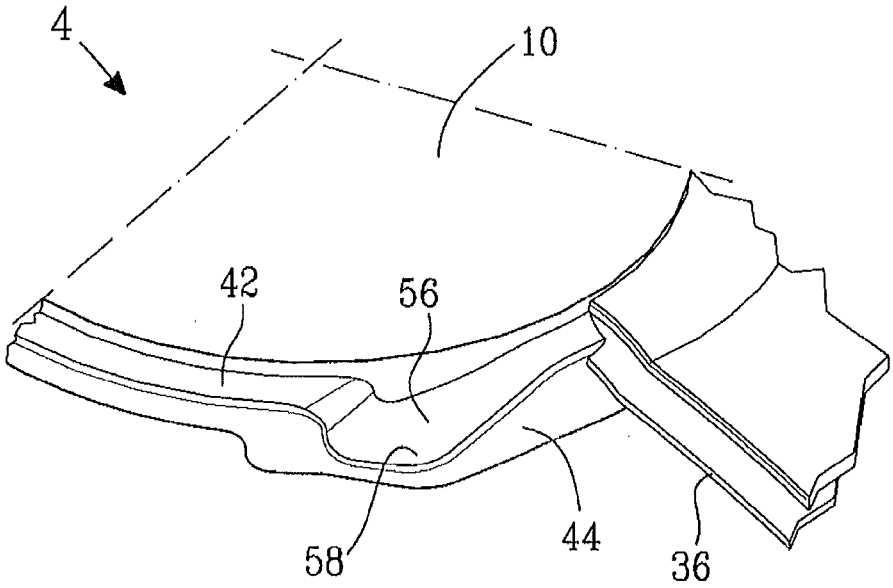

FIG. 4 illustrates a guiding element 44 of a dispenser according to example embodiments. The guiding element 44 is formed by a section of a free edge portion 42 of an upper end wall 10 of a housing 4 of the dispenser and is provided with an inclined surface 56 on its upper side. The guiding element 44 comprises an essentially horizontally extending protrusion 58 from the section of the free edge portion 42.

Figure 5:
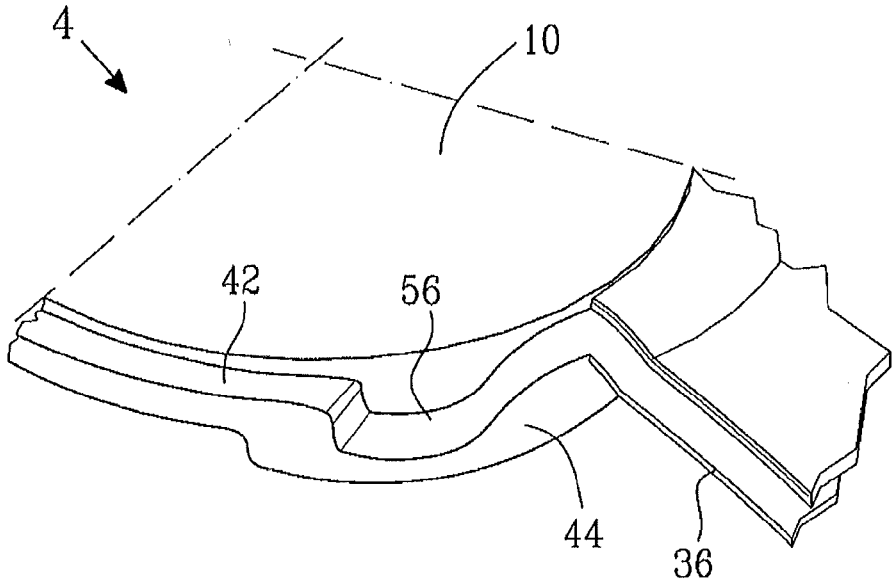

FIG. 5 illustrates a guiding element 44 of a dispenser according to example embodiments. The guiding element 44 is formed by a section of a free edge portion 42 of an upper end wall 10 of a housing 4 of the dispenser and is provided with an inclined surface 56 on its upper side. The guiding element 44 is a part of the free edge portion 42 and, in contrast with the guiding element illustrated in FIG. 4, no part of the guiding element 44 protrudes from the free edge portion 42.

Figure 6:
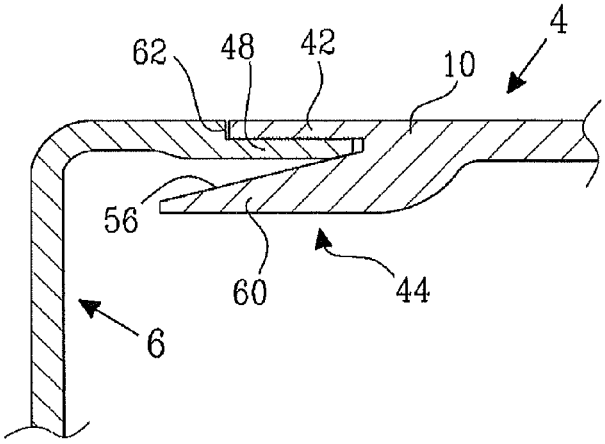
FIGS. 6 and 7 illustrate schematically sections though portions of a door and a housing of dispensers according to example embodiments.

FIG. 6 illustrates schematically a section though a portion of a door 6 and a housing 4 of a dispenser according to example embodiments. An upper end wall 10 of the housing 4 comprises a guiding element 44, which comprises an essentially horizontally extending protrusion 60 in proximity of a free edge portion 42 of the upper end wall 10. The guiding element 44 has an upwardly inclined surface 56 and is adapted to co-operate with a region of a door rim 48 of the door 6. The door rim 6 and the free edge portion 42 of the upper end wall 10 form an overlap. Adjacent the door rim 48, the door 6 is provided with a ridge 62.

Figure 7:
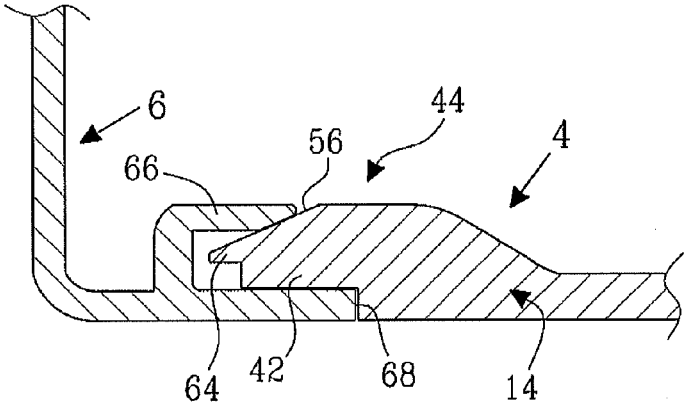

FIG. 7 illustrates schematically a section though a portion of a door 6 and a housing 4 of a dispenser according to example embodiments. A lower end wall 14 of the housing 4 comprises a guiding element 44, which comprises an essentially horizontally extending protrusion 64 adjacent a free edge portion 42 of the lower end wall 10. The guiding element 44 has an upwardly inclined surface 56 and is adapted to co-operate with a region of a door rim 48 of the door 6. Said region comprises a heel 66 adapted to abut and slide along at least a part of the inclined surface 56 of the guiding element 44. The door rim 6 and the free edge portion 42 of lower end wall 14 form an overlap. The lower end wall 14 is provided with a ridge 68.

Figure 8:
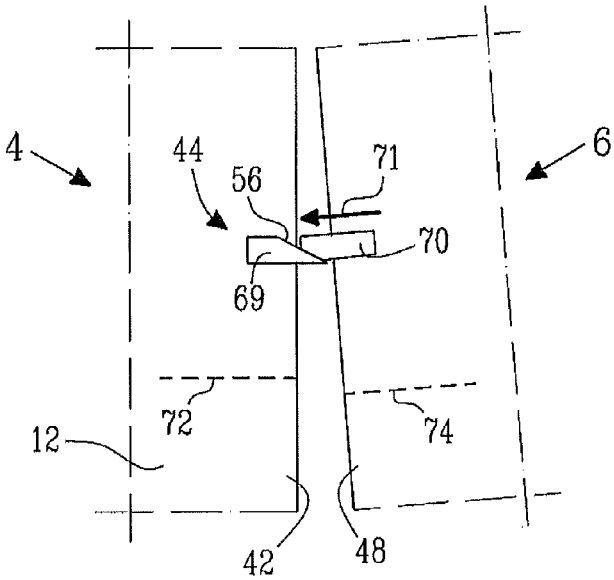
FIG. 8 illustrates schematically a view from an inside of a dispenser according to example embodiments.

FIG. 8 illustrates schematically a view from an inside of a dispenser according to example embodiments towards a substantially vertical wall 12 of a housing 4 and a door 6 of the dispenser. The door 6 is about to be closed in a direction indicated by an arrow 71 and for illustrative purposes the door 6 droops at a considerable angle. The substantially vertical wall 12 comprises in proximity of a free edge portion 42 a guiding element 44 provided with an upwardly inclined surface 56. The guiding element 44 comprises an essentially horizontally extending protrusion 69. The door 6 is in a region of a door rim 48 provided with a heel 70. The guiding element 44 and its upwardly inclined surface 56 is adapted to co-operate with the heel 70 to lift and vertically position the door 6 when it reaches a closed position on the housing 4. Dashed lines 72, 74 on the substantially vertical wall 12 of the housing 4 and the door 6 indicate possible design elements on the outside of the housing 4 and the door 6, design elements that will align when the door is properly closed.

Example embodiments may be combined as understood by a person skilled in the art. Even though the invention has been described with reference to example embodiments, many different alterations, modifications and the like will become apparent for those skilled in the art. Other types of hinges than those comprising the illustrated first and second hinge members 34, 46 may be used, e.g. a separate hinge attached at one end to the door and at the other end to the housing of the dispenser. The discontinuity in the door rim may protrude from the door rim and the segment of the free edge portion fitting the discontinuity may form an indentation in the upper end wall.

The same inventive idea as defined in the claims may be applied to a dispenser for hygienic articles such as paper towels, sheets of tissues, napkins, diapers, female hygiene products and other fibrous, film, polymer or filamentary products as well as soap, where a dosage of soap would constitute one hygienic article, the dispenser comprising a housing and a door. The door is in this case pivotally attached to the housing about a substantially horizontal axis along a lower side of the door. If the door is made from a thin material in comparison with its height, again, the door may be slightly deformed when it is open. A guiding element associated with an upper wall or one or both of two substantially vertical walls of the housing, suitably at an upper end of the substantially vertical walls will provide positioning of the door. The guiding element is provided with an upwardly inclined surface seen in a direction from the door towards the housing in a horizontal plane and adapted to co-operate with a region of the door rim during pivoting of the door towards a closed position and for vertically positioning a free end of the door. Thus, aligning of the door with the housing is achieved and the door will resume its proper shape when it is in a closed position on the housing.

Therefore, it is to be understood that the foregoing is illustrative of various example embodiments and is not to be limited to the specific embodiments disclosed and that modifications to the disclosed embodiments, combinations of features of disclosed embodiments as well as other embodiments are intended to be included within the scope of the appended claims.

The invention claimed is:

1. A dispenser for sheet material adapted to be mounted on a wall, said dispenser comprising a housing for receiving said sheet material and a door pivotally attached to said housing via a substantially vertically arranged hinge, said housing:

comprising a hinge wall associated with said substantially vertically arranged hinge, an upper end wall, a substantially vertical wall and a lower end wall, said walls defining an edge delimiting a lateral charge opening in said housing for replenishing said dispenser with said sheet material, and being provided with a dispensing opening for said sheet material at said lower end wall, said door:

comprising an essentially vertical portion, a free end opposite said hinge and a door rim at least partly adjacent said edge of said housing when said door is in a closed position, and being adapted to cover said charge opening, and wherein said edge of said housing has a hinge portion at said hinge wall and a free edge portion extending along said upper end wall, said substantially vertical wall and said lower end wall, wherein said free edge portion, or said housing in proximity of said free edge portion, comprises a fixed guiding element for co-operation with a region of said door rim during pivoting of said door towards said closed position and, the fixed guiding element includes a surface that is upwardly inclined with respect to horizontal as seen in a direction that is substantially perpendicular to the free edge portion of the housing and extending from said door towards said housing in a horizontal plane, said inclined surface being arranged so as to receive a portion of the door and support the received portion of the door so that the door is at a preferred height as the door approaches the housing.

2. The dispenser according to claim 1, wherein said guiding element-is formed by a section of said free edge portion.

3. The dispenser according to claim 1, wherein said guiding element-comprises an essentially horizontally extending protrusion.

4. The dispenser according to claim 3, wherein the essentially horizontally extending protrusion protrudes from said section of said free edge portion.

5. The dispenser according to claim 3, wherein said essentially horizontally extending protrusion is separate from said free edge portion.

6. The dispenser according to claim 1, wherein said region of said door rim is a corner portion adapted to move over said guiding element.

7. The dispenser according to claim 6, wherein said corner portion is formed by a discontinuity in said door rim and said free edge portion is provided with a segment-fitting said discontinuity.

8. The dispenser according to claim 7, wherein said discontinuity and said segment are essentially arc-shaped in an essentially horizontal plane.

9. The dispenser according to claim 1, wherein at least a part of said door rim forms an overlap with said free edge portion when said door is in said closed position, and wherein said door and said housing at least partly abut in said overlap.

10. The dispenser according to claim 9, wherein said overlap extends essentially uninterruptedly in a horizontal plane from one end of said upper end wall to an opposite end of said upper end wall in a first direction transverse to a second direction extending in said horizontal plane from said housing towards said door.

11. The dispenser according to claim 9, wherein adjacent to said overlap on an external surface of said dispenser at least part of said upper end wall, said substantially vertical wall and/or said lower end wall, or in the alternative at least part of said door adjacent to said rim, abuts a ridge in an essentially vertical plane.

12. The dispenser according to claim 11, wherein said ridge extends essentially in said first direction.

13. The dispenser according to claim 1, wherein said housing has an essentially cylindrical shape and said essentially vertical portion of said door is curved and forms part of said cylindrical shape.

14. The dispenser according to claim 1, wherein said dispenser is adapted to hold a roll of sheet material, from a center of which roll said sheet material is adapted to be grasped through said dispensing opening.

15. The dispenser according to claim 1, wherein said upper end wall includes an overlap portion that forms an overlap with a rim of the door when the door is in a closed position.

16. The dispenser according to claim 15, wherein said fixed guiding element is in a central part of the upper end wall spaced from the hinge wall and the substantially vertical wall.

17. The dispenser according to claim 1, wherein said fixed guiding element is in a central part of the upper end wall spaced from the hinge wall and the substantially vertical wall.

18. The dispenser according to claim 1, wherein one of the upper end wall and the lower end wall is substantially horizontal and includes a substantially horizontal extension having an edge extending perpendicularly away from the housing and toward the door, and the fixed guiding element extends along the edge of the extension.

* * * * *